United States Patent [19]

Bierman et al.

[11] Patent Number: 4,883,586

[45] Date of Patent: Nov. 28, 1989

[54] PROCESS FOR BENEFICIATING ORES CONTAINING FINE PARTICLES

[75] Inventors: Laurence W. Bierman; Samuel M. Polinsky; Roger B. Humberger, all of Pocatello, Id.

[73] Assignee: J. R. Simplot Co., Pocatello, Id.

[21] Appl. No.: 208,170

[22] Filed: Jun. 16, 1988

[51] Int. Cl.[4] ..... B03D 1/02

[52] U.S. Cl. ..... 209/167; 209/166; 209/170

[58] Field of Search ..... 209/166, 164, 167, 902

[56] References Cited

U.S. PATENT DOCUMENTS

| | | | |
|---|---|---|---|
| 2,610,738 | 9/1952 | Cuthbertson | 209/167 |
| 2,748,939 | 6/1956 | Hodges | 209/166 |
| 2,815,859 | 12/1957 | Hollingsworth | 209/167 |
| 3,371,779 | 3/1968 | Hollingsworth | 209/166 |
| 3,421,621 | 1/1969 | Hollingsworth | 209/166 |
| 3,522,012 | 7/1970 | Blann . | |
| 3,622,087 | 11/1971 | Oltmann . | |
| 4,083,929 | 4/1978 | Priestley . | |
| 4,158,623 | 6/1979 | Wang | 209/166 |
| 4,251,352 | 2/1981 | Shoemaker . | |
| 4,319,987 | 3/1987 | Shaw | 209/166 |
| 4,351,809 | 9/1982 | Megy et al. . | |
| 4,360,500 | 11/1982 | Fly . | |
| 4,391,784 | 7/1983 | Hill . | |
| 4,393,030 | 7/1983 | Sardisco . | |
| 4,436,616 | 3/1984 | Dufour | 209/166 |
| 4,445,926 | 5/1984 | Mills et al. . | |
| 4,536,378 | 8/1985 | White . | |
| 4,556,545 | 12/1985 | Cheruvu . | |
| 4,559,204 | 12/1985 | Agrawal . | |
| 4,568,454 | 2/1986 | Mehrotra | 209/167 |
| 4,690,752 | 9/1987 | Shaw | 209/167 |
| 4,737,273 | 4/1988 | Snow | 209/167 |

OTHER PUBLICATIONS

"Answers to Questions on the Flotation of Ores" by O. Ralston, Dep't of the Interior, 1917.

"Application of Carbonate-Silica Flotatia Techniques to West, Phosphate Materials", by Rule, Larson et al.

"Column Flotation of Montana Chromite Ore", J. D. McKay et al., Preprint No. 85-335, Society of Mining Engineers of AIME, Oct. 1985.

*Primary Examiner*—David L. Lacey
*Assistant Examiner*—Thomas M. Lithgow
*Attorney, Agent, or Firm*—Gregory O. Garmong

[57] ABSTRACT

Ores containing mineral values are separated into two slurries, one having primarily fine particles and gangue and the other having primarily coarse particles. The slurry having fine particles and gangue is adjusted to a solids content of less than about 15 percent, as necessary, and then conditioned by the addition of appropriate promoter reagents, a flotation collector, and a froth modifier. The gangue, containing a disproportionate share of impurities, is floated in a column flotation cell wherein the fine particulates are not mechanically agitated, and removed. The remaining fine particulate underflow, containing a disproportionate share of the mineral values, is then processed directly, or combined with the slurry containing the coarse particulate to yield a flow having reduced impurity content and increased recovery of the mineral values.

12 Claims, 2 Drawing Sheets

PROCESS FOR BENEFICIATING ORES CONTAINING FINE PARTICLES

BACKGROUND OF THE INVENTION

The invention relates to the beneficiation of ores and the like, and, more particularly, to a process for beneficiating and utilizing the fine particulate fraction of phosphate-containing ore.

Many important metals and chemicals are obtained in commercial quantities by mining ores that contain fairly low concentrations of the desired values in a chemically combined form, and then processing and refining the ores to yield the desired final product having a high concentration of relatively high purity material. To be efficient, most refining operations that process the chemically combined form of the mineral values to the desired product require as a starting material a modified ore that has a higher concentration of mineral values than that found in the ore when mined. Additionally, some impurities found in the as-mined ore can seriously interfere with the refining operation. In a treatment termed beneficiation utilized prior to refining, the as-mined ore is processed to increase its mineral value content and reduce particularly harmful impurities to a tolerable level in preparation for refining operations.

As a first step, the as-mined ore is mixed with water to form a slurry having 25–35 percent solids content, and comminuted, or crushed, to produce ore particles that contain the desired mineral values. During comminution, mineral particles having a wide range of sizes are produced, ranging from less than 20 micrometers to about 0.010 inch in size, in a typical sizing operation.

It is usually desired that the ore particles be rather small in size, so that the mineral values locked within the ore particles are at or near the surface and can be liberated in subsequent processing. In some operations the particles must be small in size to accommodate the requirements of particular processing machinery. For example, when the slurry is to be pumped through a slurry pipeline, the particles should be relatively small. To achieve small sizes, the slurry can be comminuted and sized and the portion containing coarse particles recycled through the comminution machinery to crush those particles that were not sufficiently reduced in a prior pass. The result of the recirculation is that the largest sizes of particles are reduced to acceptably small sizes, but also that a relatively large fraction of very fine ore particles are produced. Mixed in with the ore particles are fine pieces of various undesirable constituents that are unavoidably mined with the minerals and contain a high fraction of impurities, such as clay, silicates, carbonates, and the like, collectively termed "gangue".

The gangue particles often closely associate with the finest ore particles, which are of a size closer to the size of the gangue pieces than are the larger ore particles. The resulting slurry of fine particles and gangue is of a mud-like consistency, and is often termed a "slime".

In many beneficiation operations, the slime is separated from the slurry containing the coarse particles, and then discarded to piles or pits. The fine particles in the slime contain a substantial portion of the mineral values of the mined ore, so that the standard practice of discarding the slime results in the loss of a significant portion of the mineral values. Even with a major portion of the impurity content removed with the gangue in the slime, the remaining coarse ore particle slurry may have too high an impurity content for subsequent refining. Further beneficiation steps are therefore necessary before the ore can be refined.

An example illustrates the problems arising in beneficiating some ores. Certain Western phosphate ores with phosphate values of 25 to 35 percent contain various metallic (or clay) silicates that include aluminum (and usually other ions such as sodium, potassium, and calcium). Aluminum is present in such silicates in an amount of 1.5 to 2 percent of the ore, expressed as aluminum oxide (the conventional mode of expression in the industry). The high aluminum content can be detrimental to subsequent manufacture of phosphoric acid.

The ores are comminuted, producing a slurried mixture of coarse ore particles having sizes up to about 0.010 inch, fine ore particles having sizes less than about 20 micrometers, and a gangue having a high content of silicate clay. The fine ore particles and gangue mix to form a slime. The aluminum impurity reports unevenly to the fractions with the portion containing coarse particles having about 1 percent aluminum expressed as aluminum oxide, and the slime portion containing fine particles and gangue having about 2 to 3 percent aluminum expressed as aluminum oxide. If the slime is permitted to remain in the slurry of coarse ore particles, the high aluminum content can interfere with refining of the phosphate values from the ore in subsequent processing.

In the past, it has been common practice to remove the high-aluminum slime from the ore slurry, as in a hydrocyclone. The slime, containing fine ore particles, was discarded, and the remaining material had a reduced content of the harmful aluminum impurity. However, a significant portion of the phosphate mineral values can be lost in this way. There have been attempts to extract the mineral values from the slimes, but these have been unsuccessful, with the result that discarding of the phosphate values in the slime has become standard practice. No practical method of beneficiating the ore is known, so that the phosphate values in the slime can be recovered and the aluminum content of the ore reduced to an acceptably low level for further processing.

Accordingly, there exists a need for a method of beneficiating ores to recover an increased portion of the mineral values therein, and simultaneously reduce the content of those impurity elements whose presence interferes with subsequent refining. Such a method must be economically viable and not preclude other processing operations. The present invention fulfills this need, and further provides related advantages.

SUMMARY OF THE INVENTION

The present invention provides a process for beneficiating slurries having fine particles and gangue that form slimes. The process permits the ore particles containing the mineral values to be separated from the gangue, which is removed and discarded. The gangue typically has a high percentage of harmful impurities, so that the beneficiation process of the invention confers the dual benefits of increasing the process yield by making available the mineral content of the fine particles, and also decreasing the impurity content. The invention also provides a process for beneficiating ores using froth modifiers in the flotation units. The froth modifiers prevent buildup of stable surface froths that would otherwise interfere with operation of the flotation cell.

In accordance with one form of the invention, a process for beneficiating a phosphate-containing ore wherein the phosphates are present in both coarse and fine particles mixed with gangue comprises the steps of separating a phosphate-containing ore into two portions, a first portion comprising an aqueous slurry of gangue and fine particles containing phosphate values, and a second portion comprising an aqueous slurry of coarse particles containing phosphate values; conditioning the first portion by adding a flotation collector to the first portion and, if necessary, adjusting the solids content of the first portion to less than about 15 percent by weight of solids; and float treating the conditioned first portion to separate a gangue material fraction and a fine particle fraction containing phosphate values, but without mechanically agitating the fine particles containing phosphate values other than by action of the flotation bubbles.

In one approach to practicing the invention, an asminded phosphate ore is slurried with water so that the slurry typically has about 25–35 percent solids by weight, and ground and sized to produce fine gangue pieces mixed with ore particles ranging in size from 0.010 inch to 20 micrometers and less. The gangue and fine ore particles (generally less than about 20 micrometers in size) are separated from the coarse particle slurry with a hydrocyclone. The resulting slime of fine ore particles and gangue is beneficiated by flotation. To do so, the solids content of the slurry is adjusted to less than about 15 percent by weight, preferably from about 8 to about 12 percent, if necessary. That is, the slime outflow from the cyclone may have the required solids content. If not, water is added or removed to adjust the solids content of the slurry. A flotation collector reagent is added to the slurry, and, preferably, a depressant and a froth modifier are also added.

The conditioned slimes slurry is conveyed to a column flotation unit, wherein one fraction of the slurry is floated and removed as the overflow, and the other fraction is removed as the underflow. Preferably, the gangue is floated and removed to discard, and the fine ore particles are removed as the underflow. The column flotation unit is a tall cylinder to which the slime is added, wherein injected air floats the hydrophobic fraction. The column flotation unit is sufficiently tall that the air flotation is operable to effect separation without the need for mechanical stirring. The only agitation is provided by the rising air bubbles. This permits the fine ore particles to slowly settle to the bottom for removal. By contrast, and as has been first recognized by the inventors, in a conventional mechanical flotation unit where the feed is continuously agitated mechanically simultaneously with the injection of flotation bubbles, the mechanical agitator tends to drive the settling fine ore particles upwardly to prevent their settling to the bottom. Mechanical flotation cells are unsuitable for the present flotation operation.

It has been found that the beneficiation of slimes using this flotation process results in an unusually stable froth produced upon the upper surface of the water in the flotation cell. This froth is required to carry the gangue particles upwards, but becomes an impediment to further processing if it remains intact. A froth modifier has been discovered that permits formation of the bubbles that attach to the gangue particles, but causes the froth on the surface to be unstable and disintegrate quickly.

In accordance with this aspect of the invention, a process for suppressing the formation of a stable froth in a mineral beneficiation process comprises the steps of providing a slurry of ore particles in water; adding a flotation reagent to the slurry; adding a surfactant froth modifier reagent to the slurry; and separating the slurry into fractions by air flotation.

The froth modifier is a surfactant such as an anionic or cationic surfactant. The froth modifier is added to the slurry as part of the conditioning process and/or added to a wash water spray directed upon the froth at the upper surface of the flotation unit. Particularly useful surfactants are sodium, ammonium, or potassium di-alkylsulfosuccinates; di-sodium, di-ammonium, or di-potassiummonoester sulfosuccinates; N-alkyl sulfosuccinates; alkylaryl sulfonate; or alkylamine quanidene polyoxyethanol (the latter being cationic and the others anionic). These surfactants can be used singly, in combination, or sequentially to treat the slurry. The froth modifier is useful in the beneficiation of phosphate ores by the previously described process, but is also useful in beneficiating slurrys containing other products to be separated by flotation, such as, for example, zinc, nickel, iron, copper, gold, and chromite ores, talc, and coal. It is operable with amine and other types of collector reagents.

The separated fine ore particles in the underflow can be processed themselves, or can be mixed back into the coarse ore particle slurry for subsequent refining operations. This permits the mineral values of the fine ore particles to be recovered rather than discarded. Because a large fraction of many of the undesirable impurities are present in the gangue, removal of the gangue removes a disproportionately large fraction of the harmful impurities. Although aluminum silicate or clay is the principal gangue mineral impurity of concern, potassium, sodium, iron, and vanadium-containing mineral impurities are also removed in the gangue. The result is that the mixture of coarse ore particles and the beneficiated fine ore particles may well have a sufficiently low content of the undesirable species that further processing before refining is not necessary.

In accordance with another aspect of the invention, a process for beneficiating a feed material wherein a phosphate ore is present in both coarse and fine particles mixed with gangue comprises the steps of separating the feed material into two portions, a first portion comprising an aqueous slurry of gangue and fine ore particles containing phosphates, and a second portion comprising an aqueous slurry of coarse ore particles containing phosphates, the solids fraction of the first portion being less than about 15 percent by weight; conditioning the first portion by adding to the first portion a collector reagent to render the gangue hydrophobic, a depressant reagent to render the fine phosphate ore particles hydrophilic, and a surfactant froth modifier to prevent the formation of stable froths; and float treating the conditioned first portion in a column flotation unit cell to separate a gangue material floated fraction and a fine ore particle fraction, but without mechanically agitating the fine ore particles other than by action of the flotation bubbles.

In yet another, more specific aspect, a process for beneficiating an aqueous slurry of a phosphate-containing ore having gangue mixed therein comprises the steps of providing a slurry of a phosphate-containing ore having therein phosphate values and an aluminum content of at least about 1.5 percent by weight of the ore, expressed as aluminum oxide; sizing the phosphate-containing ore to produce a feed slurry having ore particles no larger than about 0.007 inch; separating the feed slurry into two portions, a first portion comprising an aqueous slurry of gangue and fine ore particles containing phosphates, the fine ore particles having sizes no greater than about 20 micrometers and having an aluminum content of at least about 2 to 3 percent by weight of the gangue ore particles, expressed as aluminum oxide, the solids fraction of the first portion being from about 8 to about 12 percent by weight, and a second portion comprising an aqueous slurry of coarse ore particles containing phosphates, wherein the aluminum content is about 1 percent by weight of the particles, expressed as aluminum oxide; forming a first portion feed by adding to the first portion an effective amount of an ether amine collection reagent to render the gangue hydrophobic, an effective amount of fluosilicic acid depressant reagent to render the fine ore particles hydrophilic, and an effective amount of sodium dioctosulfosuccinate as a froth modifier to prevent the formation of a stable froth; float treating the first portion feed in a column air flotation unit to separate a gangue material floated fraction having an aluminum content of at least about 5 percent by weight of the gangue, expressed as aluminum oxide, and a fine ore particle underflow fraction having an aluminum content of about 1.5 percent by weight of the ore particles, expressed as aluminum oxide, the float treating being accomplished without mechanically agitating the fine ore particles other than by action of the flotation bubbles; and combining the second portion and the fine particle fraction, the combination having an aluminum content of about 1.2 percent by weight of the solids in the combination, expressed as aluminum oxide.

It will be appreciated that the present invention provides an important advance in the art of mineral processing. Phosphate ores containing fine particles that form slimes can be processed to recover the mineral values in the fine particles and reduce the impurity content, in the beneficiated product, of those impurities that report in great part to the gangue. The processing is not expensive, and can be performed using equipment proved in other applications but heretofore unknown in the beneficiation of phosphate slimes. A froth suppression technique developed in conjunction with this process permits the flotation processing to be accomplished efficiently, and is useful in a broader range of beneficiation processing of other types of materials. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE PREFERRED EMBODIMENT

Figure 1:
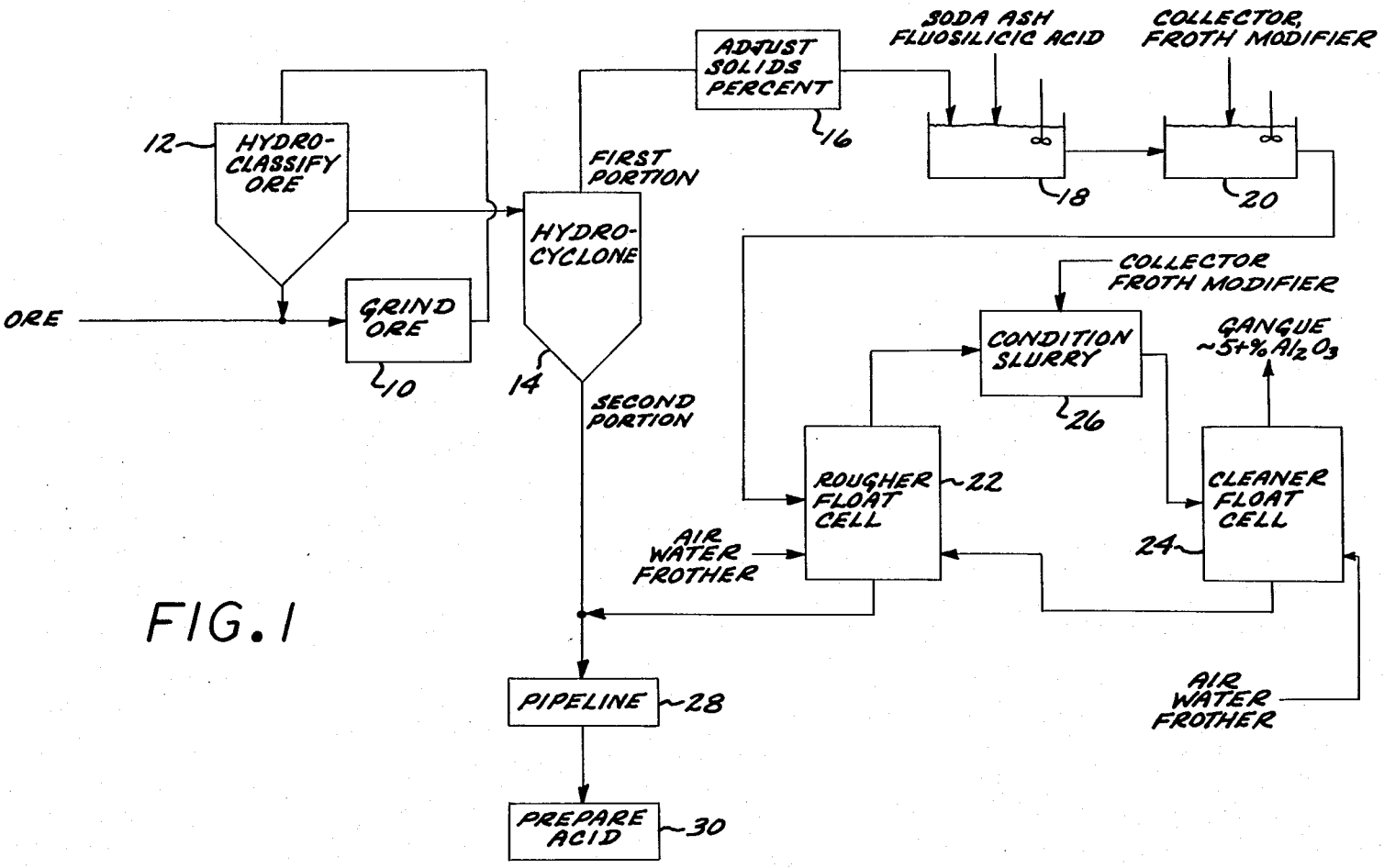
FIG. 1 is a pictorial process flow chart of the preferred embodiment of the invention.

The present invention is preferably embodied in a process for preparing a slurried flow of Smoky Canyon, Idaho, phosphate-containing ore for introduction to a slurry pipeline leading to a wet process phosphoric acid plant, as illustrated in FIG. 1. There are several requirements that necessitate careful attention to the processing of the ore prior to introduction into the pipeline. The ore must be ground to a relatively fine size distribution to be pumped through the pipeline. The fine size distribution results in a large fraction of fines, with as much as 30–40 percent of the phosphate values reporting to the fines. The fine particles mix with the gangue to form a slime. If the slime were discarded, as is normally the case in the art, then a significant fraction of the phosphate values would be discarded and lost.

Moreover, the ore contains a high fraction of aluminum expressed as aluminum oxide, typically 1.5 to 2.0 percent of the solids by weight. (The aluminum content is always expressed herein as a percent aluminum oxide, following industry convention, except where otherwise indicated.) The aluminum interfaces with the wet process acid production, which has a tolerance for no greater than about 1.2 percent aluminum expressed as aluminum oxide. The present process increases the recovery of phosphate values in the ore introduced into the pipeline, and also reduces its aluminum content below 1.2 percent aluminum expressed as aluminum oxide, which is an acceptable level for further processing.

Referring to FIG. 1, phosphate-containing, slurried ore having about 1.5 to 2.0 percent aluminum expressed as aluminum oxide is ground, as in a ball mill 10, to reduce its size. The ground ore slurry is classified in a classifier 12, with the coarsest fraction being returned to the ball mill 10 feed, and the finest fraction being sent to a hydrocyclone 14. The ore feed to the hydrocyclone 14 has a typical size distribution (in weight percent) of +65 mesh, 5 percent; −65+100 mesh, 13.9 percent; −100+150 mesh, 18.0 percent; −150+200 mesh, 8.1 percent; −200+270 mesh, 10.6 percent; −270+325 mesh, 7.2 percent; −325+400 mesh, 4.8 percent −400+500 mesh, 3.6 percent, −500 mesh, 28.8 percent.

In the hydrocyclone 14, the ore is separated into two portions, a first portion that consists of a mixture of fine particles of ore and fine particles of gangue, primarily silicate clays, and a second portion that consists of coarse particles of ore and a minor amount of gangue. As used herein, the term "fine" as applied to the size of ore particles is used to mean particles of size less than about 20 micrometers, while "coarse" particles are larger. However, the division between fine and coarse particles is necessarily somewhat flexible, as understood by those in the industry. Large scale comminution and classification processes are somewhat imprecise and do not achieve perfect separation of the coarse from the fine fraction. As a result, there is inevitably some fine material in the predominantly coarse portion, and some coarse material in the predominantly fine portion.

The composition and size distribution of actual samples of such ores will be reported in conjunction with the examples discussed below, but in general at least about 75 percent of the weight of the first portion is '500 mesh, or less than about 26 micrometers. The first portion has a phosphate content of about 25–30 percent $P_2O_5$ and 2–3 percent aluminum expressed as $Al_2O_3$, by weight of the solids. The second portion has a size distribution of at least 92 percent greater than −325 mesh. It contains about 33 percent $P_2O_5$ and about 1 percent aluminum expressed as aluminum oxide, by weight of the solids.

The first portion contains about 13 percent of the total phosphate content, and it would therefore be highly uneconomical to discard this slime forming material. On the other hand, the aluminum and other impurities preferentially report to the first portion, because most of the fine particulate gangue is liberated by size in the first portion. Thus, the first portion has a higher fraction of aluminum and other impurities than does the second portion.

The first portion is flotation separated to enhance its phosphate content and reduce its aluminum content, and then remixed with the second portion. To prepare and condition the first portion for flotation, its solids content is first adjusted to about 15 percent or less, preferably from about 8 to about 12 percent, in a solids adjuster 16. That is, less than about 15 percent of the slurry, by weight, is solid material, including both ore and gangue. The outflow of the hydrocyclone 14 may be of higher solids content, so that water would be added to the slurry in the adjuster 16, or the outflow of the hydrocyclone 14 may be of too low a solids content, so that water is removed from the slurry in the adjuster 16. If the outflow of the hydrocyclone 14 is found to be of the correct solids content, no adjustment is required.

The first portion slurry, having the proper solids content, is placed into a first conditioning tank 18, wherein flotation conditioners are added to increase flotation of the gangue and reduce flotation of the ore particles in the later flotation steps. The conditioners added in the first conditioning tank 18 are preferably ammonia, soda ash, and fluosilicic acid, and the slurry is preferably resident in the tank 18 for about 5 minutes. The ammonia is preferably added in an amount of about 2 pounds per ton of ore feed, the soda ash in an amount of about 2 pounds per ton of ore feed, and the fluosilicic acid in an amount of about 3 pounds per ton of ore feed. A mixer in the tank 18 vigorously agitates the slurry during its retention in the tank.

After conditioning in the first tank 18, the first portion slurry is advanced to a second conditioning tank 20, wherein additional flotation conditioners are added. In the second tank 20, a flotation collector to render the silicate gangue hydrophobic is added, so that the gangue can be floated. The collector is preferably a cationic primary ether amine collector, such as Sherex 98A. Such primary ether amine collectors are available commercially from a variety of manufacturers. Also added in the second conditioning tank 20 is a froth modifier to control the character of the froth formed in the flotation. The froth modifier permits the formation of the froth, which is required for flotation, but also encourages its instability upon reaching the top of the flotation cell. The need for such a froth modifier is acute, since in its absence a highly stable froth is formed on the surface of the flotation cell, which cannot be readily removed even by a wash water spray. The froth modifiers are cationic or anionic surfactants. The presently most preferred froth modifier is sodium dioctosulfosuccinate. The collector is most preferably added in the amount of about 0.75 to about 1.0 pound per ton of ore, and the froth modifier is most preferably added in the amount of about 0.1 to about 0.65 pound per ton of ore. The first portion is preferably retained in the second conditioning tank 20 for about 2 minutes.

Figure 2:
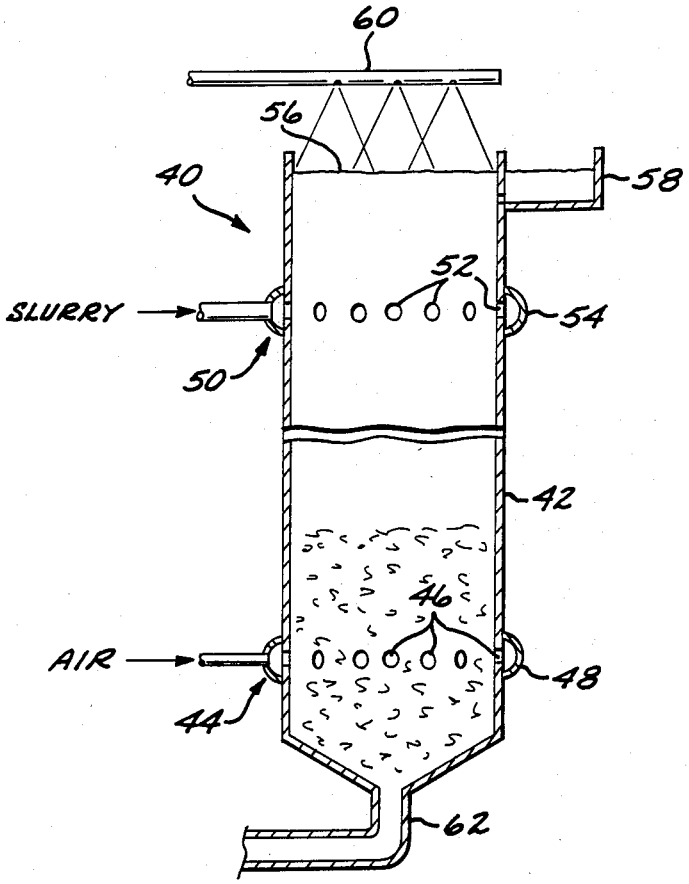
FIG. 2 is a side sectional view of a column flotation cell.

The outflow of the second conditioning tank 20 is provided to a first, or rougher, column flotation cell 22. Such a column flotation cell is illustrated in more detail in FIG. 2. A column flotation cell 40 includes a cylindrical wall 42 oriented with the axis vertical. The wall 42 encloses a volume that is typically about 8 feet in diameter and 40 feet high in a commercial form. Air, water, and a frothing agent are added at an air injector 44 near the base of the cell 40. The air injector 44 includes a number of tubes 46 running through the cylindrical volume, and fed by an air manifold 48. Each tube 46 has holes along its length through which air is forced to form bubbles of a desired size and distribution.

The slurry mixture flowing from the second conditioning tank 20, or from other sources, is added at one or more slurry injectors 50 located at a higher point of the cell 40. The injector 50 includes a series of tubes 52 running through the cylindrical volume, and fed by a slurry manifold 54. The tubes 52 have holes along their lengths, through which the slurry is forced under sufficient pressure that it flows into the cell 40.

The solid particulate, both ore and gangue, is denser than water, and begins to fall downwardly through the cell 40. At the same time, the bubbles injected through the air injector 44 rise through the mixture of ore, gangue, and water within the cell 40. As they rise, bubbles attach to the hydrophobic gangue particles, causing them to float upwardly to a top surface 56 of the liquid in the cell 40. A dense froth is otherwise formed floating on the surface 56, but the froth modifier added in the second conditioning tank 20 causes the froth to be stable only long enough for the gangue-laden particles suspended in the froth to be overflowed into the weir 58. A water spray line 60 directs a spray of water onto the surface of the froth, further aiding in reducing its stability. The slurried gangue particles that overflow into the weir 58 are conducted away.

The hydrophilic ore particles continue to sink to the bottom of the cell 40, and become the underflow of the cell 40. The underflow is removed through an underflow collector 62.

Important features of the column flotation cell 40, that distinguish it from conventional flotation cells, are its tall configuration and absence of mechanical agitation. Conventional flotation cells are much shorter, about 4–8 feet high, and relatively larger in lateral extent than height, resembling large vats or tanks. Air is added at the bottom of the cell, but there is also a mechanical agitator such as a paddlewheel or impeller that agitates the slurry to improve contact of the slurried particles with the bubbles and increase the flotation rate. It has now been found that the use of the mechanical agitator causes the fine ore particles to be circulated upwardly toward the surface, increasing the likelihood of their entrainment into the overflow, and thus decreasing the degree of separation of the ore and gangue.

In the present approach of a column flotation cell, there is no mechanical agitation other than by the motion of the bubbles. The greater height of the cell provides a longer period of time and vertical distance for the bubbles to affix themselves to the gangue particles and float them upwardly. The ore particles, on the other hand, are not mechanically circulated as in the conventional flotation cell, and are permitted to gradually descend to the bottom of the cell. Accordingly, a key feature of the present invention is the use of a column flotation cell which does not mechanically agitate the slurry, thereby permitting a gentle settling of the ore particles.

Returning to the process flow chart of FIG. 1, the outflow of the second conditioning tank 20 is provided as the inflow to a first column flotation cell 22. In the cell 22, the gangue rises to become the overflow and the concentrated ore particles sink to become the underflow, in the manner previously discussed. It will be appreciated that, as in many beneficiation processes, the separation of ore from gangue is not perfect in any one stage. In the column flotation process, some portion of the ore rises with the gangue to the overflow, and therefore does not reach the underflow.

To increase the recovery of phosphate values, the overflow of the first cell 22 is provided as the inflow to a second column flotation cell 24. Additional chemical conditioners are added in a third conditioning tank 26, prior to the slurry being added to the cell 24. In the third conditioning tank 26, the slurry is mechanically agitated, and further collector reagent and froth modifier are added. Preferably, about 0.4 pounds per tone ore of the same collector reagent is added, and about 0.2 pounds per ton of the same froth modifier is added.

The second column flotation cell 24 functions in substantially the same manner as the first cell 22, further separating the once-separated overflow from the cell 22. The underflow of the second cell 24 is recycled to the slurry injector of the first cell and further separated, and the overflow of the second cell 24 is removed for disposal or further processing. The frother requirement is about 0.03 pounds per tone ore in the second cell 24.

As will be illustrated in the examples discussed subsequently, the use of two cells alters the ratio of the rejection of aluminum and the recovery of phosphate values. Additional stages of flotation could be used to gain even further changes, but experience indicates that the use of additional stages of flotation are not economically justified in terms of additional chemical consumption, operating cost, and capital cost expenditures, for this ore system.

The underflow of the first column flotation cell 22 is added back to the second portion of the slurry, which had been previously separated in the hydrocyclone 14. The first portion has an aluminum content, expressed as aluminum oxide, of about 1 percent by weight of the solids, and the underflow from the cell 22 has an aluminum content, expressed as aluminum oxide, of about 1.5 percent by weight of the solids. Upon mixing, the combined flow feed to a pipeline 28, and thence to an acid preparation plant 30, has an aluminum content, expressed as aluminum oxide, of slightly less than 1.2 percent by weight of the solids of the slurry, thus meeting the requirement of the acid preparation process. The flotation separation of the slimes portion has the benefits of alleviating the aluminum problem by removing much of the gangue, reducing the undesirable impurity content to an acceptably low value, increasing the net phosphate recovery, and reducing the total mass of material that must be transported through the pipeline 28, thereby reducing the pumping power requirements.

The following examples will illustrate aspects of the process of the invention, but should not be taken as limiting the scope of the invention in any respect.

EXAMPLE 1

A first ore sample from the Smoky Canyon Mine was crushed and hydrocycloned, producing a first portion having a sieve analysis (in weight percent) of +325 mesh, 6 percent; +400 mesh, 12 percent; +500 mesh, 22 percent; and −500 mesh, 78 percent.

The first portion was conditioned in a first conditioning tank by adding 2 pounds per ton ammonia, 2 pounds per ton soda ash, and 3 pounds per ton fluosilicic acid. Retention time was 5 minutes.

The first portion was further conditioned in a second conditioning tank by adding with about 0.9 pounds per ton Sherex 98A collector and about 0.4 pounds per ton sodium dioctosulfosuccinate. Retention time in the second tank was about 2 minutes.

The conditioned slurry was provided to a first (rougher) column flotation cell having dimensions of 2½ inch diameter by 22 feet high, at a rate so as not to exceed a superficial rise rate of 0.7 centimeters per second. The concentration of Dowfroth 250 frother added to the cell was 0.02 pounds per ton of ore feed.

The overflow of the first column flotation cell was reconditioned in a third conditioning tank by the addition of 0.4 pounds per ton of Aerosurf 98A collector reagent and 0.02 pounds per ton of froth modifier Astrowet 0-70PG. Retention time was 2 minutes.

The reconditioned overflow slurry was supplied to a second (cleaner) column flotation cell having the same dimensions and gas flow as the first column flotation cell. The concentration of Dowfroth 250 frother added to the cell was 0.03 pounds per ton of ore.

The overflow and underflow of each cell were collected, dried, and analyzed. In this Example 1, the underflow of the second cell was not recycled to the first cell, but was simply collected for comparison purposes. The materials balance is reported in the following Table 1:

TABLE 1

| | | Composition, wt. % | | | Distribution, Wt. % | |
|---|---|---|---|---|---|---|
| Product | Fraction | Wt. % | P2O5% | Al2O3% | P2O5% | Al2O3% |
| First | Sink | 45.0 | 30.3 | 1.0 | 49.2 | 19.5 |
| Cell | Float | 55.0 | 25.4 | 3.4 | 50.8 | 80.5 |
| | Feed | 100.0 | 27.7 | 2.3 | 100.0 | 100.0 |
| Second | Sink | 41.6 | 28.5 | 1.4 | 46.6 | 17.6 |
| Cell | Float | 58.4 | 23.5 | 4.8 | 53.4 | 82.4 |
| | Feed | 100.0 | 25.4 | 3.4 | 100.0 | 100.0 |
| Com- | Sink | 67.5 | 29.8 | 1.15 | 72.6 | 33.8 |
| posite | Float | 32.5 | 23.5 | 4.8 | 27.4 | 66.2 |
| | Feed | 100.0 | 27.7 | 2.3 | 100.0 | 100.0 |

In this example, 68 percent of the aluminum was rejected, and 73 percent of the $P_2O_5$ values recovered from the slimes feed material. When mixed back with the coarse second fraction separated in the hydrocyclone, the mixture has enhanced recovery of phosphate values and reduced aluminum silicates and other gangue, as compared with the original sample taken from the mine.

EXAMPLE 2

Another sample of material was taken from the hydrocyclone separation. In this second sample, the sieve analysis (in weight percent) was ±325 mesh, 3 percent; +400 mesh, 6 percent; +500 mesh, 12 percent; and −500 mesh, 88 percent. The $P_2O_5$ content was 27.5 percent and the $Al_2O_3$ content was 2.68 percent.

The sample was treated using the same procedure as in Example 1, except that the underflow of the second flotation cell was recycled to the first flotation cell, in the manner discussed for the preferred embodiment in relation to FIG. 1. That is, the difference between the study of Example 1 and that of Example 2 was the recycling of the underflow of the second cell, to determine the effect of the recycling.

The overflow and underflow products were sampled, and the samples dried and analyzed. The results are reported in Table 2:

TABLE 2

| Product | Fraction | Composition, wt. % | | | Distribution, Wt. % | |
|---|---|---|---|---|---|---|
| | | Wt. % | P2O5% | Al2O3% | P2O5% | Al2O3% |
| First Cell | Sink | 63.3 | 30.0 | 1.1 | 67.6 | 30.0 |
| | Float | 35.7 | 24.8 | 4.4 | 32.4 | 70.0 |
| | Feed | 100.0 | 28.1 | 2.3 | 100.0 | 100.0 |
| Second | Sink | 35.1 | 29.2 | 1.6 | 41.3 | 12.8 |
| | Float | 54.9 | 22.4 | 5.9 | 58.7 | 87.2 |
| | Feed | 100.0 | 24.8 | 4.4 | 100.0 | 100.0 |
| Composite | Sink | 72.6 | 29.5 | 1.7 | 77.3 | 45.7 |
| | Float | 23.8 | 21.9 | 5.9 | 22.7 | 54.3 |
| | Feed | 100.0 | 27.7 | 2.7 | 100.0 | 100.0 |

In this example, 52 percent of the aluminum was rejected, and 81 percent of the $P_2O_5$ values recovered from the slimes feed material. When mixed back with the coarse second fraction separated in the hydrocyclone, the mixture has enhanced recovery of phosphate values and reduced aluminum silicates and other gangue, as compared with the original sample taken from the mine.

EXAMPLE 3

A flotation cell of the type used for Examples 1 and 2 was operated with and without the use of the froth modifier surfactant sodium dioctosulfosuccinate, in order to obtain samples of the froths. The first froth sample was collected when the cell was operated without the froth modifier, and the second froth sample was collected when the cell was operated with the froth modifier added in the amount of about 0.4 pounds per ton of ore feed. The first sample was set aside, and after 3 days its froth volume had been reduced by only 50 percent, indicating an unusually stable froth. The froth on the second sample disappeared completely after about 5 minutes.

As compared with the process of Example 1, wherein the underflow of the second cell is not recycled, the process of Example 2 yields a higher recovery of phosphate values and lower rejection of aluminum impurity. Because the combined flow of coarse and fine material in Example 2 still meets the requirement of a maximum of 1.2 percent aluminum content, expressed as aluminum oxide, and a greater recovery of phosphate was achieved, the process configuration of Example 2, including recycling of the underflow of the second cell, was selected as the most preferred approach. However, it will be seen that the approach of Example 1 could be selected in the event that a greater rejection of aluminum was required, but at the price of a slightly smaller recovery of the phosphate. Example 3 illustrates the use of the surfactant in reducing froth stability, so that the froth produced in the flotation cell can be removed.

It will be appreciated that the approach of the present invention yields important advantages in increasing the recovery of mineral values and rejecting undesirable impurities, and greatly reducing the problems associated with the inclusion of impurities such as aluminum in ore feeds. Although particular embodiments of the invention have been described in detail for purposes of illustration, various modifications may be made without departing from the spirit and scope of the invention. Accordingly, the invention is not to be limited except as by the appended claims.

What is claimed is:

1. A process for beneficiating a phosphate-containing ore wherein the phosphates are present in both coarse and fine particles mixed with gangue, comprising the steps of:

separating the phosphate-containing ore into two portions, a first portion consisting essentially of an aqueous slurry of fine gangue particles and fine value particles containing phosphate values, at least about 75 percent of the particles in said first portion having a size of less than about 26 micrometers, the fine value particles having a size of less than about 20 micrometers, and a second portion comprising an aqueous slurry of coarse particles having a size greater than about 20 micrometers containing phosphate values;

conditioning the first portion by adding a flotation collector to the first portion that renders the gangue particles hydrophobic and adjusting the solids content of the first portion to less than about 15 percent by weight of solids if the solids content is greater than about 15 percent; and subjecting the conditioned, less than about 15% solids first portion to froth flotation to separate a gangue concentrated fraction and a fine value particle fraction containing enriched phosphate values, but without mechanically agitating the fine value particles containing phosphate values other than by action of the flotation bubbles.

2. The process of claim 1, wherein the step of separating is accomplished in a hydrocyclone.

3. The process of claim 1, including the further step of:

combining the second portion and the fine value particle fraction, after the step of froth flotation.

4. The process of claim 1, wherein the solids content of the first portion is from about 8 to about 12 percent by weight during said froth flotation.

5. The process of claim 1, wherein a froth modifier is added to the first portion during the step of conditioning.

6. A process for beneficiating a feed material wherein a phosphate ore is present in both coarse and fine particles mixed with gangue particles in said feed material, comprising the steps of:

separating the feed material into two portions, a first portion consisting essentially of an aqueous slurry of gangue particles and fine ore particles containing phosphates, at least about 75 percent of the particles in said first portion having a size of less than about 26 micrometers and the fine ore particles having a size of less than about 20 micrometers, and a ore particles containing phosphates, the solids fraction of the first portion being less than about 15 percent by weight;

conditioning the first portion by adding to the first portion a gangue collector reagent to render the gangue hydrophobic, a phosphate depressant reagent to render the fine phosphate ore particles hydrophilic, and a surfactant froth modifier to prevent the formation of stable froths; and subjecting the conditioned first portion to froth flotation in a column flotation unit cell to separate a gangue concentrated floated fraction and a fine enriched ore particle fraction, but without mechanically agitating the fine ore particles other than by action of the flotation bubbles.

7. The process of claim 6, wherein said step of separating is accomplished in a hydrocyclone.

8. The process of claim 6, including the further step of:

combining the second portion and the fine particle ore fraction, after said step of froth flotation.

9. The process of claim 6, wherein the solids content of the first portion is from about 8 to about 12 percent by weight during said froth flotation.

10. A process for beneficiating an aqueous slurry of a phosphate-containing ore having gangue particles mixed therein, comprising the steps of:

providing a slurry of said phosphate-containing ore having therein phosphate values and an aluminum content of at least about 1.5 percent by weight of the ore, expressed as aluminum oxide;

sizing the phosphate-containing ore to produce a feed slurry having ore particles no larger than about 0.007 inch;

separating the feed slurry into two portions, a first portion consisting essentially of an aqueous slurry of fine gangue particles and fine ore particles containing phosphates, the fine ore particles having sizes no greater than about 20 micrometers at least about 75 percent of the particles in said first portion having a size of less than about 26 micrometers and said first portion having an aluminum content of at least about 2 to 3 percent by weight of the fine gangue particles plus fine ore particles, expressed as aluminum oxide, the solids fraction of the first portion being from about 8 to about 12 percent by weight, and a second portion comprising an aqueous slurry of coarse ore particles containing phosphates, wherein the aluminum content is about 1 percent by weight of the particles, expressed as aluminum oxide;

forming a conditioned feed by adding to the first portion an effective amount of an ether amine gangue collection reagent sufficient to render the gangue hydrophobic, an effective amount of fluosilicic acid phosphate depressant reagent sufficient to render the fine ore particles hydrophilic, and an effective amount of sodium dioctosulfosuccinate as a froth modifier sufficient to prevent the formation of a stable froth;

subjecting the conditioned feed to froth flotation in a column air flotation unit to separate a fine gangue particles concentrated floated fraction having an aluminum content of at least about 5 percent by weight of the gangue fraction expressed as aluminum oxide, and a fine ore particle underflow fraction having an aluminum content of about 1.5 percent by weight of the ore particle fraction, expressed as aluminum oxide, the froth flotation being accomplished without mechanically agitating the fine ore particles other than by action of the flotation bubbles; and combining the second portion and the fine ore particle fraction, the combination having an aluminum content of about 1.2 percent by weight of the solids in the combination, expressed as aluminum oxide.

11. The process of claim 10, wherein said step of separating is accomplished in a hydrocyclone.

12. The process of claim 10, wherein said step of froth flotation is accomplished in at least two stages of column flotation units.

* * * * *